US012320345B2

(12) United States Patent
Ayar et al.

(10) Patent No.: US 12,320,345 B2
(45) Date of Patent: Jun. 3, 2025

(54) APPARATUS FOR DAMPING PRESSURE PULSATION FOR A COMPRESSOR OF A GASEOUS FLUID

(71) Applicant: Hanon Systems, Daejeon (KR)

(72) Inventors: Ayhan Ayar, Cologne (DE); Jacek Gerhard Bennek, Cologne (DE); Philip Andres, Cologne (DE)

(73) Assignee: HANON SYSTEMS, Daejeon (KR)

( * ) Notice: Subject to any disclaimer, the term of this patent is extended or adjusted under 35 U.S.C. 154(b) by 40 days.

(21) Appl. No.: 17/755,857

(22) PCT Filed: Apr. 12, 2021

(86) PCT No.: PCT/KR2021/004560
§ 371 (c)(1),
(2) Date: May 10, 2022

(87) PCT Pub. No.: WO2021/210863
PCT Pub. Date: Oct. 21, 2021

(65) Prior Publication Data

US 2023/0022916 A1 Jan. 26, 2023

(30) Foreign Application Priority Data

Apr. 14, 2020 (DE) ..... 10 2020 110 181.3

(51) Int. Cl.
*F04B 39/00* (2006.01)
*F04B 39/12* (2006.01)

(52) U.S. Cl.
CPC ..... *F04B 39/0055* (2013.01); *F04B 39/121* (2013.01)

(58) Field of Classification Search
CPC .. F04B 39/0055; F04B 39/0005; F04B 39/10; F04B 39/1013; F04B 39/102;
(Continued)

(56) References Cited

U.S. PATENT DOCUMENTS

RE41,861 E 10/2010 Landhuis
8,366,407 B2 2/2013 Hayashi et al.
(Continued)

FOREIGN PATENT DOCUMENTS

CN 110173414 A 8/2019
DE 112017000161 B4 9/2023
(Continued)

*Primary Examiner* — Kenneth J Hansen
*Assistant Examiner* — Chirag Jariwala
(74) *Attorney, Agent, or Firm* — Shumaker, Loop & Kendrick, LLP; James D. Miller

(57) ABSTRACT

An apparatus for damping pressure pulsation for a compressor of a gaseous fluid in a refrigerant circuit including a housing with an inlet opening and at least one first outlet opening and a piston element movable in an axial direction within a volume enclosed by the housing and supported on the housing in a beared manner via a spring element, wherein the piston element respectively controls a flow cross section of the inlet opening and the first outlet opening, wherein the piston element and the housing have at least one first sealing surface and a second sealing surface. The first sealing surfaces form a first seat and the second sealing surfaces form a second seat, wherein between the seats, one chamber enclosed by the housing and the piston element for expanding the fluid when flowing into the chamber and/or at least one second outlet opening in the housing is formed.

14 Claims, 6 Drawing Sheets

(58) Field of Classification Search
CPC .... F04B 39/1033; F04B 39/121; F04B 53/10; F04B 53/102; F04B 53/1032; F04B 53/1085; F04B 39/0027; F04B 39/0061; F04B 39/0066; F04B 39/072; F04B 39/12; F16K 15/02; F16K 15/025; F16K 15/026; F16K 15/06; F16K 15/063; F16K 15/064; F16K 15/066
See application file for complete search history.

(56) References Cited

U.S. PATENT DOCUMENTS

| | | | | |
|---|---|---|---|---|
| 10,539,243 | B2 * | 1/2020 | Vallee | F01P 11/08 |
| 2008/0199329 | A1 * | 8/2008 | Hayashi | F04B 27/08 417/307 |
| 2011/0076171 | A1 | 3/2011 | Park et al. | |
| 2013/0306166 | A1 | 11/2013 | Erb | |
| 2014/0311596 | A1 * | 10/2014 | Kim | F16K 15/026 137/528 |

FOREIGN PATENT DOCUMENTS

| | | | | |
|---|---|---|---|---|
| EP | 2660469 | A1 * | 11/2013 | F04B 27/1009 |
| GB | 2278663 | B | 12/1996 | |
| JP | H06159538 | A | 6/1994 | |
| JP | 2019178646 | A | 10/2019 | |
| KR | 20120133206 | A | 12/2012 | |
| KR | 20150014921 | A | 2/2015 | |
| KR | 101697164 | B1 | 1/2017 | |
| KR | 101791151 | B1 | 10/2017 | |

* cited by examiner

APPARATUS FOR DAMPING PRESSURE PULSATION FOR A COMPRESSOR OF A GASEOUS FLUID

CROSS REFERENCE TO RELATED APPLICATIONS

This is a U.S. national phase patent application of PCT/KR2021/004560 filed Apr. 12, 2021 which claims the benefit of and priority to German Pat. Appl. No. 10 2020 110 181.3 filed on Apr. 14, 2020, the entire contents of each of which are incorporated herein by reference.

TECHNICAL FIELD

The invention relates to an apparatus for damping pressure pulsation for a compressor of a gaseous fluid, in particular a refrigerant, in a refrigerant circuit of an air-conditioning system of a motor vehicle. The apparatus has a housing with an inlet opening and at least one outlet opening and a piston element. The piston element is movable in an axial direction within a volume enclosed by the housing and supported in a beared manner on the housing via a spring element.

BACKGROUND ART

Compressors known from the state of the art for mobile applications, in particular for air-conditioning systems of motor vehicles for conveying refrigerant through a refrigerant circuit, hereinafter also referred to as a refrigerant compressor, are often formed as a piston compressor with variable stroke or with variable stroke volume, also referred to as displacement, or as a scroll compressor, irrespective of the refrigerant. In particular in the case of refrigerant compressors driven by a belt or a pulley, the rotation rate is set via the speed of the motor vehicle, in particular via the rotation rate of the drive engine. The piston compressors with variable stroke guarantee a smooth operation of the air-conditioning system as the compressor has a required constant or variable performance independent of the rotation rate of the drive engine.

During operation, pressure pulses, also referred to as pressure pulsation, are created on the suction side as well as on the pressure side through the linear movement of the piston within the piston compressor or the circumferential scroll movement of the movable spiral within the scroll compressor. The pressure pulsation is transferred via the components of the refrigerant circuit, such as connection lines and heat exchangers as well as their brackets. By exciting the components via the pressure pulsation, noise which is audible for the passenger within the passenger compartment or living beings outside the vehicle and can be perceived as disturbing, can be emitted.

Thus, the pressure pulsation is also transferred to the air-conditioner arranged in the passenger compartment via the heat exchanger of the refrigerant circuit operated as an evaporator. Due to its construction, the air-conditioner acts as a large, flat surface and thus in the way of a speaker or amplifier of the pulsation. The noise created under unfavorable circumstances, in particular resonance arrangements, thus act directly on the passenger, in particular the driver.

For reasons stated, common compressors are formed with an apparatus for damping and reducing the occurring pressure pulsation in order to in particular reduce pressure pulsation which occurs during the operation of the compressor with low loads, i.e. with a low mass flow to be conveyed.

In doing so, the function of the apparatus for damping the pressure pulsation consists in changing or adapting a flow cross section, in particular an abrupt change of the flow cross section, for the fluid to be compressed by the compressor.

Thus, the fluid can for example be guided through a throttle point with a constant cross section, which causes an increase of the flow speed and a downstream expansion of the fluid. The abrupt change of the flow cross section and thus of the pressure and the speed of the fluid causes an increase of a pressure pulsation loss, which in turn reduces or dampens the pressure pulsation which is transferred into the vehicle interior by the connection line of the refrigerant circuit and causes noise.

However, the throttle point with a constant cross section also causes pressure losses which increase with an increasing flow cross section.

Furthermore, it is known from the state of the art to provide spring-loaded return valves in the suction pipe or in the outlet pipe of the compressor which suppress oil migration in the off state on the one hand. By restricting the volume flow of the fluid through the defined valve opening, the pressure pulsation is, on the other hand, however dampened depending on the volume flow, similar to the throttle point with a constant cross section. The opening characteristics of the valve are determined by the geometry of the valve opening and of the closure body as well as the spring constant.

Furthermore, such a valve can be configured to, for example, sense a pressure of the compressor acting on the closure body in order to adapt the opening of the valve to the operating conditions and thus create only a minimum pressure loss.

Thus, DE 94 09 659 U1 discloses a return valve with a throughflow limiter for reducing the pressure losses with maximum throughflow in a hydraulics system. The valve has a housing with an inner chamber and a valve element with a return spring and a hydraulic differential control. In the closed state, the valve element abuts a seat of the housing when the fluid flows in the first direction of the regulatable throughflow, and is opened when the fluid flows in the second direction opposite to the first direction. The valve formed as a seat valve with a control slide operated through dynamic flow forces has spring-actuated return means.

U.S. Pat. No. 8,366,407 B2 describes an apparatus for reducing the pressure pulsation in a compressor of a refrigerant circuit with variable displacement. The apparatus formed as a damper element with varying volume has a flow passage and a control valve. The control valve is formed with a valve housing, a slider valve with a through bore and a damping chamber. The damping chamber is connected to the refrigerant circuit via the through bore. The effective cross sectional area and the effective length of the through bore are determined on the basis of the frequency of a specific pulsation of the refrigerant gas and the volume of the damping chamber at the time of the development of the specific pulsation.

Common apparatus for reducing the pressure pulsation of a compressor exclusively close and open when reaching a specific limit value of the mass flow depending on the damper characteristics, such as a spring constant and the size of a damper end face in order to reduce fluctuations of the mass flow and pressure peaks connected therewith, in particular during an operation of the compressor with low and minimum loads. The provision of a damper with a variable volume leads to a varying damping behavior during the operation of the compressor which can differ from the target frequency range and thus cannot cause a reduction of the pulsation.

By using return valves, pressure losses are created within the flow of the fluid. If for example the valve is set to a specific pressure or volume flow of the fluid, a substantial pressure loss is caused in particular when exceeding the set value of the volume flow. The pressure loss can be reduced by providing a spring with a smaller spring constant or by forming larger flow cross sections, wherein in particular in the case of low volume flows, the pressure pulsation as well is reduced only slightly. However, in particular during the operation with low volume flows of the fluid, in particular of the refrigerant, reducing the pressure pulsation is of great importance, as during the operation with a low volume flow of the refrigerant, the air-conditioner is also subjected only to low air volume flows such that the created pressure pulsation in the passenger compartment can be audible very much and therefore be disturbing.

Valves with a pressure acting on the closure body and thus, for example, a possibility to pick off the crankcase pressure or a further working pressure of the compressor require a very high construction demand and consequently costs as the corresponding pressure is to be guided to the valve through flow channels formed within the compressor in a gas-tight manner. Furthermore, leakage between the areas subjected to different pressures within the valve are to be avoided, which further increases the construction demand and the costs.

Furthermore, so-called reflection silencers with a housing enclosing a cylindrical volume with openings formed at the end faces arranged opposite to each other for the inflow and the outflow of the fluid are known from the state of the art. The openings have a respective substantially smaller diameter than the housing such that the abrupt changes of the diameter formed at the openings respectively cause the abrupt change of the flow cross section for the fluid flowing through the housing. Due to the impedance jump caused by the abrupt change from the small inner diameter of the connection line of the refrigerant circuit to the large inner diameter of the housing or to the inner volume of the silencer, sound waves occurring as pressure pulsation in the line are dampened.

Apart from high space requirements, the known silencers mostly have additional elements to be produced as well as an interior arrangement which is very complicated to produce, which respectively increase the production costs and the manufacturing effort.

As the silencers known from the state of the art have a very large installation space in order to reach a significant damping effect, which however is very limited in modern motor vehicles, in particular in passenger vehicles, the provided silencers either reach no sufficient damping effect or the use of a silencer must be omitted.

SUMMARY

The object of the invention is to provide an apparatus for damping pressure pulsation, in particular of a compressor of a gaseous fluid in a refrigerant circuit which causes a maximum noise damping, in particular in the case of low volume flows of the compressed fluid. The pressure losses should be minimal. By damping the pressure pulsation, noise emissions which influence the comfort for example for passengers of a passenger compartment are to be avoided, among other things. The apparatus should have a simple construction of a minimum number of components with minimum space requirements, a minimum use of materials and therefore a minimum weight. Further, the production and assembly costs should be minimal. The installation space of the apparatus is to be designed such that the apparatus is compatible with components which are already present, also to replace them.

The object is solved by the subject matter as shown and described herein.

The object is solved by an apparatus for damping pressure pulsation according to the invention for a compressor of a gaseous fluid, in particular a refrigerant. The apparatus has a housing with an inlet opening and at least one first outlet opening and a piston element. The piston element is movable in an axial direction within a volume enclosed by the housing and is arranged in a beared manner supported on the housing via a spring element. By moving the piston element, a respective flow cross section of the inlet opening and the first outlet opening are controlled.

According to the design of the invention, the piston element and the housing respectively have at least one first sealing surface and one second sealing surface. In doing so, the first sealing surfaces together form a first seat, whereas the second sealing surfaces together form a second seat. Between the seats, a respective at least one chamber enclosed by the housing and the piston element for expanding the fluid during the inflow into the chamber or at least one second outlet opening within the wall of the housing is provided.

The apparatus which, apart from the housing, only has the spring-loaded piston element is preferably formed with a plurality of valve-like seats and expansion chambers in order to significantly reduce the occurring pressure pulsation. The seats are preferably arranged along the movement direction of the piston element in order to exactly control the mass flow of the fluid. The movement direction of the piston element is aligned along a longitudinal axis of the piston element and the housing.

According to a further development of the invention, the housing has a hollow cylindrical, in particular a hollow circular cylindrical shape with an open first end face and a closed second end face arranged distally to the first end face.

The open first end face of the housing is preferably formed as an inlet opening for the fluid.

The at least one first outlet opening is advantageously provided at an outer surface and in the region of the second end face of the housing. The piston element together with the housing forms at least one first outflow opening as a region of the at least one first outlet opening of the housing which is not covered by the piston element.

According to an advantageous design of the invention, the first sealing surface fully encloses the inlet opening. The second sealing surface of the housing is preferably formed at an inner wall and fully enclosing the inner wall as well as in a region of a side of the at least one first outlet opening facing the inlet opening. In doing so, the sealing surfaces of the housing are respectively arranged between the inlet opening and the at least one first outlet opening.

According to a further preferred design of the invention, the at least one second outlet opening adjacent to the first sealing surface of the housing is arranged such that the first sealing surface is formed in the radial direction between the inlet opening and the second outlet opening. This means that the second outlet opening is arranged in the radial direction offset to the outside around the first sealing surface of the housing.

A further advantage of the invention is that the at least one second outlet opening is formed as a straight flow channel with a low flow cross section and at least one change in direction, in particular a reversal of direction. In doing so, the second outlet opening is in particular a fully controllable pre-outlet with a labyrinth-like flow path or a bypass to the first outlet opening.

According to a further development of the invention, the piston element is formed from at least two sections which are oriented towards one another on a common longitudinal axis in the axial direction. In doing so, the end face of the piston element is preferably oriented towards the inlet opening of the housing.

According to a first alternative design of the invention, the piston element has a first section, a second section and a third section.

The first section of the piston element is preferably formed in the shape of a circular disc, in particular a cylindrical circular disc, especially curved at least on one side. In doing so, the first section of the piston element can have a convexly curved free surface which is arranged oriented towards the direction of the inlet opening of the housing. A circumferential surface of the first section of the piston element can have recesses, in particular in the shape of circular ring sections or wedge-shaped recesses, which extend from the circumferential surface in the radial direction to the longitudinal axis. When forming the recesses as circular ring sections, adjacently arranged circular ring sections can be separated from each other by webs which extend in the radial direction to the outside to the maximum outer diameter of the first section of the piston element.

The second section of the piston element preferably has a cylindrical, in particular a circular cylindrical shape and is connected to a second surface of the first section of the piston element at a first end face. In doing so, the outer diameter of the second section of the piston element advantageously is smaller than the outer diameter of the first section of the piston element.

The third section of the piston element is preferably formed in the shape of a hollow cylinder, in particular a hollow circular cylinder. The third section of the piston element can have a closed first end face and an open second end face arranged distally to the first end face. In doing so, the first end face can be connected to the second section of the piston element and the second end face can be arranged towards a closed second end face of the housing. The third section of the piston element is preferably formed with an outer diameter which corresponds to an inner diameter of the housing minus a clearance for moving the piston element within the housing.

According to a second alternative design of the invention, the piston element has a first section and a second section.

The first section of the piston element preferably is formed in the shape of a circular truncated cone or a hollow cylinder, in particular a hollow circular cylinder, with a conical outer surface and a closed first end face. An outer diameter of the first section of the piston element is advantageously smaller than an inner diameter of the housing, such that an annular flow path for the fluid is formed between an inner wall of the housing and a circumferential surface of the first section of the piston element. In doing so, a circumferential surface of the first section of the piston element can have recesses, in particular in the shape of circular ring sections or wedge-shaped recesses, which extend from the circumferential surface in the radial direction to the longitudinal axis.

According to a further advantageous design of the invention, the first sealing surface of the piston element is formed at the surface of the first section of the piston element oriented towards the direction of the inlet opening of the housing or at the first end face of the second section of the piston element oriented towards the direction of the inlet opening of the housing. In doing so, the first sealing surface can fully enclose the first section of the piston element in the region of the second end face.

According to a further development of the invention, the second sealing surface of the piston element is provided at an outer wall of the third section of the piston element or at an outer wall of the second section of the piston element. In doing so, the second sealing surface can respectively fully enclose the outer wall.

The apparatus can further have a bypass opening which provides a connection for guiding the fluid from the inlet opening to at least one outlet opening, such that the fluid can pass, in particular flow around the apparatus in a closed state as well.

In doing so, the bypass opening can be formed within the piston element and extend starting from an end face oriented in the direction of the inlet opening of the housing in the axial direction through the piston element. Furthermore, the housing can have a bypass opening which connects a volume formed at the inlet opening to a volume formed at an outlet opening.

The bypass opening within the piston element or the bypass opening within the housing can be formed alternately or together as required.

A further advantage of the invention is that the spring element is formed as a coil spring, in particular a pressure spring, preferably in a cylindrical manner. In doing so, a longitudinal axis of the spring element can be arranged on a longitudinal axis of the piston element and of the housing.

The spring element is preferably arranged supported on a support of the housing with a first end and on the support on the piston element with a second end. In doing so, the support is formed at a closed first end face of the third section of the piston element.

The spring element can be arranged concentrically within the piston element at least in regions depending on the deflection.

According to a further preferred design of the invention, the piston element is arranged in a first end position at a minimum distance to the inlet opening of the housing, in particular supported on the first sealing surface of the housing such that the flow cross section of the inlet opening or the at least one first outlet opening of the housing is closed. In a second end position, the piston element is preferably arranged in a maximal distance to the inlet opening of the housing such that the flow cross section of the inlet opening and of the at least one first outlet opening are fully opened.

According to a further development of the invention, either the at least one first outlet opening of the housing is arranged oriented towards a suction region of the compressor or the inlet opening of the housing is arranged oriented towards an outlet region of the compressor. Thus, the apparatus can be arranged in the flow direction of the fluid upstream or downstream of the compressor, i.e. in the suction path as well as in the outlet path of the compressor.

In an advantageous method for operating an apparatus described above for damping pressure pulsation for a compressor of a gaseous fluid, in particular a refrigerant, a respective flow cross section of an inlet opening formed in the housing or a first outlet opening are controlled by moving a piston element within a volume enclosed by a housing and supported in a beared manner on the housing via a spring element in an axial direction.

The piston element is preferably moved through the apparatus depending on the mass flow of the fluid. In doing so, a flow cross section of a first seat formed of first sealing surfaces between the piston element and the housing or a flow cross section of a second seat formed of second surfaces between the piston element and the housing are respectively changed between fully opened and closed. The mass flow of the fluid is accelerated and expanded several times in succession when passing the apparatus. Accelerating and expanding several times means a succession of the procedures of at least two times.

The piston element is preferably moved by a pressure force caused by the flow of the fluid and the spring force of the spring element such that the first seat and the second seat are opened, in particular the first sealing surfaces and the second sealing surfaces are arranged spaced apart from each other. In doing so, the fluid, when flowing through the first seat, is guided into a chamber for expansion and flows out through the second seat as well as opened first outlet openings of the housing.

Furthermore, the fluid can flow out through opened second outlet openings and be accelerated and expanded when flowing through the outlet openings.

Alternatively, the piston element is advantageously moved by a pressure force created by the flow of the fluid and the spring force of the spring element such that the first seat is opened, in particular the first sealing surfaces are arranged spaced apart from each other, and the second seat is closed, in particular the first sealing surfaces abut each other. In doing so, the first outlet openings of the housing are closed and the fluid flows out through opened second outlet openings. When flowing through the outlet openings, the fluid is accelerated and expanded.

Before flowing out of the apparatus, the fluid can be guided through a chamber for expansion.

The apparatus for damping pressure pulsation according to the invention is preferably used in a refrigerant compressor of a refrigerant circuit, in particular an air-conditioning system of a motor vehicle.

The apparatus preferably has a combination of a plurality of flow cross section reductions or constrictions as well as additional volumes or deflections of the flow direction.

The apparatus according to the invention for damping pressure pulsation for a compressor in summary has further diverse advantages:

- reducing pressure pulsation which affects the interior acoustics of a motor vehicle in a disturbing manner or avoiding noise emissions which influence comfort, for example for passengers of the passenger compartment,
- minimum pressure losses and minimum influence on the performance of the compressor during operation, therefore maximum volumetric effectiveness and maximum efficiency during operation of the compressor as well as minimum additional energy consumption of the air-conditioning system,
- simple construction from a minimum number of components with minimum space requirements with a plurality of flow paths,
- universal use in every connection of any compressor such as a piston compressor or a scroll compressor which is powered electrically or mechanically, and
- minimum costs for production and assembly.

BRIEF DESCRIPTION OF DRAWINGS

Further details, features and advantages of designs of the invention result from the following description of example embodiments with reference to the associated drawings. The figures respectively show an apparatus for damping pressure pulsation for a compressor with a housing as well as a piston element which is arranged movably in an axial direction within a volume enclosed by the housing and spring-loaded in an axial longitudinal sectional view. It is shown.

DESCRIPTION OF AN EMBODIMENT

Figure 1A:
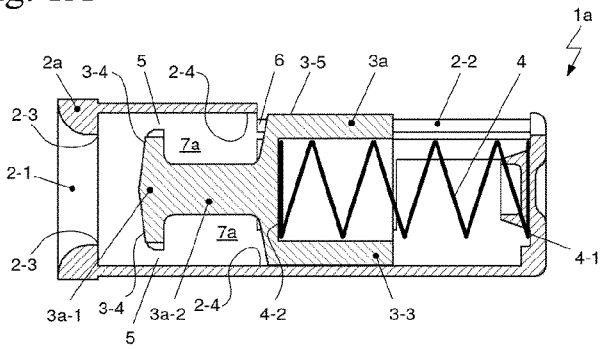
FIGS. 1A and 1B: a first and a second embodiment with different design of the piston element.
Figure 1B:
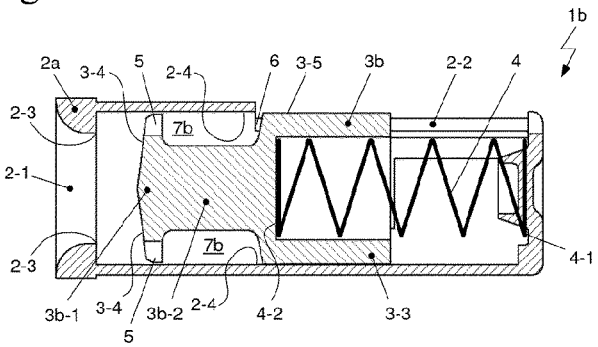

FIGS. 1A and 1B indicate a first embodiment and a second embodiment of an apparatus 1*a*, 1*b* for damping pressure pulsation for a compressor with a housing 2*a* as well as a piston element 3*a*, 3*b* which is arranged movably in an axial direction within a volume enclosed by the housing 2*a* and spring-loaded in an axial longitudinal sectional view.

The housing 2*a* formed for guiding the piston element 3*a*, 3*b* is fully arranged within a fluid channel of the fluid circuit, in particular of a refrigerant circuit, such that the fluid completely flows through the housing 2*a*. The housing 2*a* substantially has a hollow cylindrical, in particular a hollow circular cylindrical shape with an open first end face and a closed second end face arranged distally to the first end face. In doing so, the open first end face of the housing 2*a* is formed as an inlet opening 2-1. The outer surface of the hollow circular cylindrical housing 2*a* is provided with at least one outlet opening 2-2 in the region of the closed second end face.

The piston element 3*a*, 3*b* guided in the housing 2*a* has a first section 3*a*-1, 3*b*-1, a second section 3*a*-2, 3*b*-2 and a third section 3-3 which are arranged in the axial direction to one another. The sections 3*a*-1, 3*b*-1, 3*a*-2, 3*b*-2, 3-3 are arranged on a common longitudinal axis.

The first section 3*a*-1, 3*b*-1 is formed in the shape of a curved, cylindrical circular disc. A convexly curved free surface of the first section 3*a*-1, 3*b*-1 is oriented in the direction of the inlet opening 2-1 and thus to the open first end face of the housing 2*a*. The flow created by the fluid acts as a pressure force on the piston element 3*a*, 3*b* at the convexly curved first side of the first section 3*a*-1, 3*b*-1. The outer diameter of the circular disc can, on the one hand, according to the first embodiment of the apparatus 1*a* of FIG. 1A, be substantially less than the inner diameter of the hollow cylindrical housing 2*a* such that there is always a ring-shaped flow path for the fluid opened between the inner wall of the housing 2*a* and the circumferential surface of the circular disc. On the other hand, the outer diameter of the circular disc, according to the second embodiment of the apparatus 1*b* of FIG. 1B, can correspond to the inner diameter of the hollow circular cylindrical housing 2*a* minus only a gap for moving the piston element 3*b* within the housing 2*a*.

The circumferential surface of the circular disc of the first section 3*a*-1, 3*b*-1 of the piston element 3*a*, 3*b* has recesses, in particular in the shape of circular ring sections or wedge-shaped recesses, which extend from the circumferential surface in the direction of the axis of the circular disc. The recesses provide open flow paths for the fluid independent of the outer diameter of the circular disc.

The second section 3*a*-2, 3*b*-2 of the piston element 3*a*, 3*b* has a cylindrical, in particular a circular cylindrical shape. In doing so, the second section 3*a*-2, 3*b*-2 is connected to a second surface of the first section 3*a*-1, 3*b*-1 at a first end face of the cylinder. The second section 3*a*-2, 3*b*-2 has a smaller outer diameter than the first section 3*a*-1, 3*b*-1 of the piston element 3*a*, 3*b*. In doing so, the outer diameter of the second section 3*a*-2, 3*b*-2 can vary depending on the embodiment.

At a second end face which is formed distally to the first end face of the cylinder, the second section 3*a*-2, 3*b*-2 of the piston element 3*a*, 3*b* is connected to the third section 3-3 which substantially has a hollow cylindrical, in particular a hollow circular cylindrical shape with a closed first end face and an open second end face arranged distally to the first end face. The third section 3-3 of the piston element 3*a*, 3*b* is connected to the second section 3*a*-2, 3*b*-2 in the region of the closed first end face. The open second end face of the third section 3-3 of the piston element 3*a*, 3*b* is oriented towards the closed second end face of the housing 2*a*.

The outer diameter of the hollow circular cylindrical third section 3-3 corresponds to the inner diameter of the hollow circular cylindrical housing 2*a* minus a clearance for moving the piston element 3*a*, 3*b* within the housing 2*a*. Between the outer side of the outer surface of the third section 3-3 of the piston element 3*a*, 3*b* and the inner wall of the housing 2*a*, fluid-tight regions are formed which prevent a fluid mass flow, in particular a refrigerant mass flow, depending on the relative arrangement of the piston element 3*a*, 3*b* to the housing 2*a*.

The housing 2*a* has, at the open first end face, a first sealing surface 2-3 which fully encloses the inlet opening 2-1 and, at the inner wall, a second sealing surface 2-4 which fully encloses the inner wall. The second sealing surface 2-4 of the housing 2*a* is formed in a region of the sides of the outlet openings 2-2 oriented towards the inlet opening 2-1.

The piston element 3*a*, 3*b* has, at the convexly curved free surface of the first section 3*a*-1, 3*b*-1 oriented in the direction of the inlet opening 2-1 and thus to the open first end face of the housing 2*a*, a first sealing surface 3-4 which corresponds with the first sealing surface 2-3 of the housing 2*a* which fully encloses the inlet opening 2-1. Furthermore, the third section 3-3 of the piston element 3*a*, 3*b* is formed with a second sealing surface 3-5 which is provided at the outer wall of the hollow circular cylindrical section 3-3. The second sealing surface 3-5 is formed fully enclosing the outer wall of the third section 3-3 or at least respectively in a region of an outlet opening 2-2 of the housing 2*a*. The second sealing surface 3-5 of the piston element 3*a*, 3*b* respectively corresponds with the second sealing surface 2-4 of the housing 2*a*.

The piston element 3*a*, 3*b*, together with the housing 2*a*, forms throughflow openings 5 and at least one outflow opening 6 through which the fluid, in particular the refrigerant, can flow. The throughflow openings 5 are limited from the circumferential surface of the circular disc of the first section 3*a*-1, 3*b*-1 of the piston element 3*a*, 3*b* with the recesses and the inner wall of the housing 2*a*, while each outflow opening 6 represents a region of an outlet opening 2-2 of the housing 2*a* which is not covered by the piston element 3*a*, 3*b*. With the change of the axial position of the piston element 3*a*, 3*b* relative to the housing 2*a*, on the one hand, the size of the second sealing surface 2-4 of the housing 2*a* and the second sealing surface 3-5 of the piston element 3*a*, 3*b* which abut each other and correspond with each other, and on the other hand, the size of the flow cross sections at the inlet opening 2-1 and the outflow openings 6 can be varied.

The piston element 3*a*, 3*b* is moved by means of the flow force or pressure force of the fluid flowing through the inlet opening 2-1 into the housing 2*a* acting on the piston element 3*a*, 3*b* at the convexly curved first side of the first section 3*a*-1, 3*b*-1 and by a spring force acting on the piston element 3*a*, 3*b* in the opposite axial direction of the flow force of the fluid. Between the housing 2*a* and the piston element 3*a*, 3*b*, a spring element 4 is provided, which is arranged in a beared manner at a support 4-1 on the housing 2*a* on the one hand and at a support 4-2 on the piston element 3*a*, 3*b* on the other hand.

The spring element 4 formed as a coil spring, in particular a pressure spring, especially cylindrical, is arranged with the coil axis on the longitudinal axis of the housing 2*a* and the piston element 3*a*, 3*b*. In doing so, the spring element 4 abuts the support 4-1 of the housing 2*a* with a first end, while the second end of the spring element 4 abuts the support 4-2 of the piston element 3*a*, 3*b*. The spring element 4 is arranged concentrically to the longitudinal axis of the housing 2*a* via a centering aid in the region of the support 4-1.

The support 4-2 for the spring element 4 is provided at the closed first end face of the third section 3-3 of the piston element 3*a*, 3*b* such that the spring element 4 is fixed in a centered manner in the region of the second end within the volume enclosed by the hollow cylindrical third section 3-3. The spring element 4 protrudes through the open second end face into the volume enclosed by the third section 3-3 of the piston element 3*a*, 3*b* and is arranged concentrically within the piston element 3*a*, 3*b* at least in regions depending on the pressure forces acting on the piston element 3*a*, 3*b*.

The spring force of the spring element 4 acting as a pressure force constitutes a counter force to the flow force of the fluid acting as a pressure force. The respective pressure forces respectively act along the axial direction opposite to each other. The arrangement of the piston element 3*a*, 3*b* within the housing 2*a* for varying the sizes of the flow cross sections at the inlet opening 2-1 and the outflow openings 6 results from the spring constants of the spring element 4 depending on the flow force applied by the fluid.

The piston element 3*a*, 3*b* is guided at the sealing surfaces 2-3, 3-4, 2-4, 3-5 within the housing 2*a* corresponding with each other and designed as seats. In doing so, the first seat is formed with the first sealing surface 2-3 of the housing 2*a* and the first sealing surface 3-4 of the piston element 3*a*, 3*b* in the shape of a cone seat with the minimum throughflow openings 5 configured as recesses in the region of the circumferential surface of the circular disc of the first section 3*a*-1, 3*b*-1 of the piston element 3*a*, 3*b*. The second seat is formed with the second sealing surface 2-4 of the housing 2*a* and the second sealing surface 3-5 of the piston element 3*a*, 3*b* as a slider with several outflow openings 6 arranged in the radial direction in the housing 2*a*.

The mass flow of the fluid, in particular the refrigerant mass flow, is accelerated due to the respective cross sectional narrowing when flowing through the seats. In doing so, the first sealing surfaces 2-3, 3-4 and the second sealing surfaces 2-4, 3-5 are arranged spaced apart from each other in the flow direction of the fluid such that a chamber 7*a*, 7*b* of sufficient size for expanding and thus decelerating the mass flow is formed between the two seats.

The volumes of the chambers 7*a*, 7*b* of the apparatus 1*a*, 1*b* are limited by the inner side of the outer surface of the hollow circular cylindrical housing 2*a*, the second surface of the first section 3*a*-1, 3*b*-1 of the piston element 3*a*, 3*b*, the outer side of the second section 3*a*-2, 3*b*-2 of the piston element 3*a*, 3*b* and the first end face of the third section 3-3 of the piston elements 3*a*, 3*b* and differ in size. The different size of the chambers 7*a*, 7*b* is enabled, according to the embodiments of FIGS. 1A and 1B, in particular through the variation of the outer diameter of the second section 3*a*-2, 3*b*-2. Furthermore, the size of the chambers 7*a*, 7*b* can be changed via the length of the apparatus 1*a*, 1*b* for a given outer diameter of the housing 2*a*.

The piston element 3*a*, 3*b* is moved within the housing 2*a* depending on the mass flow of the fluid through the apparatus 1*a*, 1*b* in the axial direction and thus the flow cross sections on the seats or between the sealing surfaces 2-3, 3-4, 2-4, 3-5 are increased or reduced correspondingly in order to correspond to the respective mass flow. When passing the apparatus 1*a*, 1*b*, the mass flow is accelerated and expanded several times in succession. In doing so, the energy of the pressure pulses or of the pressure pulsation in the mass flow is converted into kinetic energy and back into pressure energy several times through the acceleration. This reduces the amplitudes of the impulses. The serial connection of the seats as bottlenecks and the expansion volumes cause an improved pulsation dampening with the same or lower pressure loss compared to the apparatus known from the state of the art.

Figure 2A:
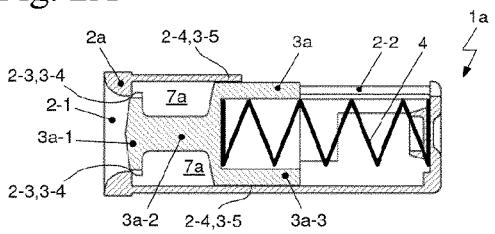
FIG. 2A to 2C: the first embodiment of the apparatus of FIG. 1A in different operating states.
Figure 2B:
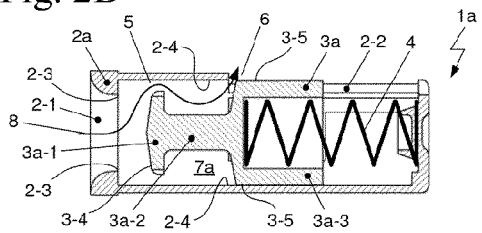
Figure 2C:
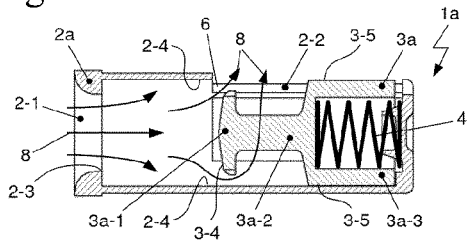

FIG. 2A to 2C respectively show the first embodiment of the apparatus 1*a* of FIG. 1A in different operating states.

FIG. 2A reveals the apparatus 1*a* in a closed state and therefore without mass flow. The housing 2*a* and the piston element 3*a* form two closed seats with respective sealing surfaces 2-3, 3-4, 2-4, 3-5 which abut each other in a sealing manner. Both the first seat with the first sealing surfaces 2-3, 3-4 and the second seat with the second sealing surfaces 2-4, 3-5 are closed. The first sealing surface 3-4 of the piston element 3*a* formed at the first section 3*a*-1 is pressed against the first sealing surface 2-3 which fully encloses the inlet opening 2-1 of the housing 2*a* through the pressure force applied by the spring element 4.

FIG. 2B represents the apparatus 1*a* in a minimum opened state and thus a state with a low or minimum mass flow in the flow direction 8 of the fluid through the apparatus 1*a*.

With the movement of the piston element 3*a* in the axial direction caused by an increasing pressure force created by the flow of the fluid and acting on the piston element 3*a*, both the first sealing surfaces 2-3, 3-4 of the first seat and the second sealing surfaces 2-4, 3-5 of the second seat are moved away from each other, the seats are opened. The fluid flowing through the inlet opening 2-1 of the housing 2*a* into the apparatus 1*a* is guided through the throughflow openings 5 as opened first seats into the chamber 7*a* and expanded due to the large increase of the flow cross section. The fluid then flows out of the apparatus 1*a* through the outflow openings 6 as opened second seats under increasing pressure and is again expanded.

The opening of the throughflow openings 5 and of the outflow openings 6 can be simultaneously or sequentially, depending on the design of the apparatus 1*a*, in particular the dimensions of the housing 2*a* and the piston element 3*a*. Furthermore, the flow speed of the fluid can be varied with a different size of the volume of the chamber 7*a*, 7*b* of the apparatus 1*a*, 1*b* as part of the flow path of the fluid through the apparatus 1*a*, 1*b*.

FIG. 2C shows the apparatus 1*a* in a fully opened state with a maximum mass flow in the flow direction 8 of the fluid through the apparatus 1*a*. With the movement of the piston element 3*a* in the axial direction caused by a maximum pressure force created by the flow of the fluid and acting on the piston element 3*a*, both the first sealing surfaces 2-3, 3-4 of the first seat and the second sealing surfaces 2-4, 3-5 of the second seat are further moved away from each other, the seats are fully opened. The fluid flowing through the inlet opening 2-1 of the housing 2*a* into the apparatus 1*a* is guided out of the apparatus 1*a* through the fully opened outflow openings 6. As the outflow openings 6 are arranged distributed around the circumference of the apparatus 1*a*, the mass flow for an outflow opening 6 represented with the flow direction 8 is represented as an example. The chamber 7*a* is not formed.

According to an alternative embodiment which is not represented, the apparatus has more than two seats. Each region formed as a chamber or enlarged volume between the seats serves the expansion of the fluid. The seats are respectively configured to open a passage with a smaller flow cross section for the fluid such that the flow cross section for the fluid is reduced at least two times in the flow direction of the fluid and the fluid is expanded when flowing through the seats. The respective open flow cross section of each seat is varied with the stroke of the piston element and thus adapted to the throughflow.

The design of the ratios of the sealing surfaces of the seats and the expansion surfaces can change the function of compensation of pressure pulsation waves. The opening characteristics of the apparatus can be adapted via the design of the seats.

Figure 3:
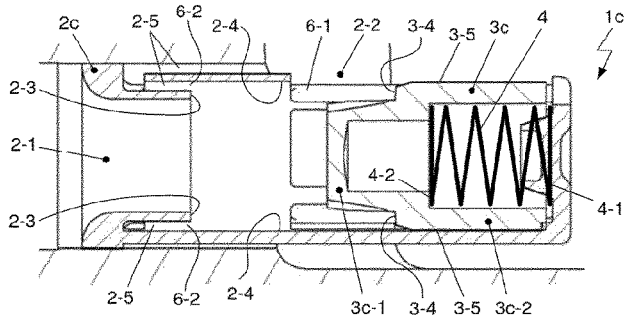
FIG. 3: a third embodiment with a housing with pre-outlets for the outflow of the fluid as well as a deviating design of the piston element in comparison to the above apparatus.

FIG. 3 shows a third embodiment of an apparatus 1*c* for damping pressure pulsation for a compressor with a housing 2*c* and a spring-loaded piston element 3*c* movably arranged in the axial direction within the volume enclosed by the housing 2*c* in an axial length cross sectional view.

The housing 2*c* formed for guiding the piston element 3*c* again is fully arranged within a fluid channel of the fluid circuit, in particular of a refrigerant circuit, such that the fluid completely flows through the housing 2*c*. The housing 2*c* substantially has, like in the first and the second embodiment according to FIGS. 1A and 1B, a hollow cylindrical, in particular a hollow circular cylindrical shape with an open first end face and a closed second end face arranged distally to the first end face. In doing so, the open first end face of the housing 2*c* is formed as an inlet opening 2-1. The outer surface of the hollow circular cylindrical housing 2*c* is provided with at least one first outlet opening 2-2 in the region of the closed second end face. The same elements of the apparatus 1*a*, 1*b*, 1*c* which are repeated in the different embodiments are characterized with same reference numerals.

A substantial difference compared to the apparatus 1*a*, 1*b* of the first and the second embodiment according to FIGS. 1A and 1B is in the form of the piston element 3*c*.

The piston element 3*c* guided in the housing 2*c* has a first section 3*c*-1 and a second section 3*c*-2 which are arranged towards one another on a common longitudinal axis in the axial direction.

The first section 3*c*-1 of the piston element 3*c* is formed in the shape of a circular truncated cone or a hollow cylinder, in particular a hollow circular cylinder, with a slightly conical outer surface and a closed first end face. The first end face at which the flow created by the fluid acts on the pressure element 3*c* as a pressure force is arranged in the direction of the inlet opening 2-1 and thus to the open first end face of the housing 2*c*.

The outer diameter of the first section 3*c*-1 of the piston element 3*c* is smaller than the inner diameter of the hollow circular cylindrical housing 2*c* such that there is always an annular flow path for the fluid opened between the inner wall of the housing 2*c* and the circumferential surface of the circular truncated cone. Furthermore, the outer diameter of the first section 3*c*-1 of the piston element 3*c* substantially corresponds to the inner diameter of the inlet opening 2-1. Due to the conical form of the first section 3*c*-1, the piston element 3*c* can be inserted into the inlet opening 2-1 with the first end face of the first section 3*c*-1 ahead and arranged centrally within the inlet opening 2-1.

The circumferential surface of the frustoconical first section 3*c*-1 of the piston element 3*c* has recesses, in particular in the shape of circular ring sections or wedge-shaped recesses, which extend from the circumferential surface in the direction of the longitudinal axis of the piston element 3*c*. The recesses can provide open flow paths for the fluid with an arrangement of the piston element 3*c* within the inlet opening 2-1 as well.

At a second end face which is formed distally to the first end face of the circular truncated cone, the first section 3*c*-1 of the piston element 3*c* is connected to the second section 3*c*-2 which substantially has a hollow cylindrical, in particular a hollow circular cylindrical shape with a first end face and an open second end face arranged distally to the first end face. The second section 3*c*-2 of the piston element 3*c* is connected to the first section 3*c*-1 in the region of the first end face. The open second end face of the second section 3*c*-2 of the piston element 3*c* is oriented towards the closed second end face of the housing 2*c*.

The outer diameter of the hollow circular cylindrical second section 3*c*-2 corresponds to the inner diameter of the hollow circular cylindrical housing 2*c* minus a clearance for moving the piston element 3*c* within the housing 2*c*. Between the outer side of the outer surface of the second section 3*c*-2 of the piston element 3*c* and the inner wall of the housing 2*c*, fluid-tight regions are formed which prevent a fluid mass flow, in particular a refrigerant mass flow, depending on the relative arrangement of the piston element 3*c* to the housing 2*c*.

The housing 2*c* of the third embodiment of the apparatus 1*c* of FIG. 3 also has the first sealing surface 2-3 which fully encloses the inlet opening 2-1 at the open first end face and the second sealing surface 2-4 which fully encloses the inner wall at the inner wall, which is formed in a region of the sides of the outlet openings 2-2 oriented towards the inlet opening 2-1.

The piston element 3*c* has, at the first end face of the second section 3*c*-2 oriented in the direction of the inlet opening 2-1 and thus to the open first end face of the housing 2*c*, a first sealing surface 3-4 which corresponds with the first sealing surface 2-3 of the housing 2*c* which fully encloses the inlet opening 2-1. In doing so, the first sealing surface 3-4 is formed such that it fully encloses the first section 3*c*-1 in the region of the second end face. Furthermore, the second section 3*c*-2 of the piston element 3*c* has a second sealing surface 3-5 which is provided at the outer wall of the hollow circular cylindrical second section 3*c*-2. The second sealing surface 3-5 is formed fully enclosing the outer wall of the second section 3*c*-2 or at least respectively in a region of an outlet opening 2-2 of the housing 2*c*. The second sealing surface 3-5 of the piston element 3*c* corresponds with the second sealing surface 2-4 of the housing 2*c*.

The piston element 3*c* together with the housing 2*c* forms at least one first outflow opening 6-1 through which the fluid, in particular the refrigerant flows. The first outflow opening 6-1 constitutes a region of an outlet opening 2-2 of the housing 2*c* which is not covered by the piston element 3*c*. With the change of the axial position of the piston element 3*c* relative to the housing 2*c*, on the one hand, the size of the second sealing surface 2-4 of the housing 2*c* and the second sealing surface 3-5 of the piston element 3*c* which abut each other and correspond with each other, and on the other hand, the size of the flow cross sections at the inlet opening 2-1 and the outflow openings 6-1 can be varied.

A further substantial difference compared to the apparatus 1*a*, 1*b* of the first and the second embodiment according to FIGS. 1A and 1B is in the form of the housing 2*c* with the arrangement of additional second outlet openings 2-5 for the fluid. The second outlet openings 2-5 which are respectively formed as a pre-outlet have the shape of a straight flow channel with a smaller flow cross section and are formed with a change in direction. Furthermore, several changes in direction of the flow within the flow channel can be guaranteed with flow directing baffles provided in the flow channel.

A pre-outlet 2-5 respectively extends from the region of the inlet opening 2-1 to the region of the outlet openings 2-2 of the housing 2*c*. In doing so, a respective first end of the pre-outlet 2-5 is arranged as a second outflow opening 6-2 adjacent to the first sealing surface 2-3 of the housing 2*c* which fully encloses the inlet opening 2-1 such that the second outflow openings 6-2 border the first sealing surface 2-3 as first ends of the pre-outlets 2-5 in the radial direction offset to the outside. The first sealing surface 2-3 of the housing 2*c* is formed in the radial direction between the inlet opening 2-1 and the second outflow openings 6-2.

In doing so, substantially two straight sections of a pre-outlet 2-5 are respectively oriented in parallel to the inlet opening 2-1 and connected to one another via a deflection section such that a mass flow of the fluid which is guided through the pre-outlet 2-5, after flowing through the inlet opening 2-1, experiences a first deflection and when flowing through the deflection section, experiences a second deflection of the flow direction of 180° in each case and flows out of the pre-outlet 2-5 through a second end in the region of the outlet openings 2-2.

The piston element 3*c* is moved by means of the flow force or pressure force of the fluid flowing through the inlet opening 2-1 into the housing 2*c* acting on the piston element 3*c* at the first end face of the first section 3*c*-1 and depending on the arrangement of the piston element 3*c* within the housing 2*c* also on the first sealing surface 3-4 and a spring force acting on the piston element 3*c* in the opposite axial direction of the flow force of the fluid. Between the housing 2*c* and the piston element 3*c*, a spring element 4 is provided, which is arranged in a beared manner at a support 4-1 on the housing 2*c* on the one hand and at a support 4-2 on the piston element 3*c* on the other hand.

The support 4-2 for the spring element 4 is formed at the first end face of the second section 3*c*-2 of the piston element 3*c* such that the spring element 4 is fixed in a centered manner within the volume enclosed by the hollow cylindrical second section 3*c*-2. The spring element 4 protrudes through the open second end face into the volume enclosed by the second section 3*c*-2 of the piston element 3*c* and is arranged concentrically within the piston element 3*c* at least in regions depending on the pressure forces acting on the piston element 3*c*.

The piston element 3*c* is moved within the housing 2*c* depending on the mass flow of the fluid through the apparatus 1*c* in the axial direction and thus the flow cross sections on the seats or between the sealing surfaces 2-3, 3-4, 2-4, 3-5 are increased or reduced correspondingly in order to correspond to the respective mass flow. The mass flow of the fluid can be guided through the apparatus 1*c* via different flow paths, wherein the respective flow path of the fluid depends on the position of the piston element 3*c* within the housing 2*c* or on the relative arrangement of the piston element 3*c* and the housing 2*c* with regard to each other.

FIG. 4A to 4D respectively show the third embodiment of the apparatus 1*c* of FIG. 3 in different operating states and detailed representations.

Figure 4A:
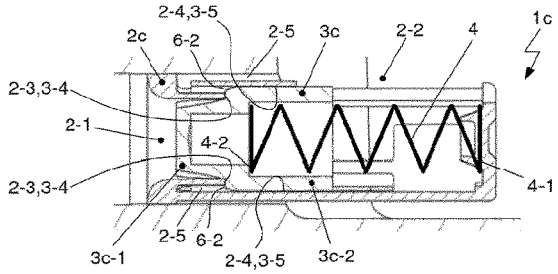
FIG. 4A to 4D: the third embodiment of the apparatus of FIG. 3 in different operating states and detail representations.

FIG. 4A shows the apparatus 1*c* in a closed state and therefore without mass flow. The housing 2*c* and the piston element 3*c* form two closed seats with respective sealing surfaces 2-3, 3-4, 2-4, 3-5 which abut each other in a sealing manner. Both the first seat with the first sealing surfaces 2-3, 3-4 and the second seat with the second sealing surfaces 2-4, 3-5 are closed. The first sealing surface 3-4 of the piston element 3*c* formed at the second section 3*c*-2 is pressed against the first sealing surface 2-3 which fully encloses the inlet opening 2-1 of the housing 2*c* through the pressure force applied by the spring element 4. The first section 3*c*-1 of the piston element 3*c* is arranged within the inlet opening 2-1.

Figure 4B:
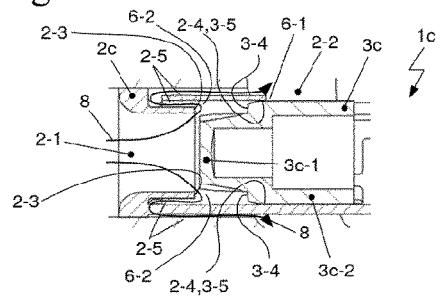

FIG. 4B reveals the apparatus 1*c* in a state with closed first outflow openings 6-1 or closed first outlet openings 2-2 of the housing 2*c* and opened second outflow openings 6-2 or opened second outlet openings 2-5 of the housing 2*c* and thus a state with a low or minimum mass flow in the flow direction 8 of the fluid through the apparatus 1*c* in a detailed representation.

Through the movement of the piston element 2*c* in the axial direction caused by an increasing pressure force created by the flow of the fluid and acting on the piston element 3*c*, the first sealing surfaces 2-3, 3-4 of the first seat are moved away from each other, while the second sealing surfaces 2-4, 3-5 of the second seat still abut each other. At a low load, i.e. a low mass flow of the fluid, the piston element 3*c*, starting from the arrangement of the fully closed state of the apparatus 1*c* of FIG. 4A, only moves a short distance such that first only the second outlet openings 2-5 of the housing 2*c* configured as pre-outlets are opened. The outlet openings 2-5 are opened after a minimum stroke of the piston element 3*c*.

This means that the first seat is opened while the second seat remains closed. The fluid flowing through the inlet opening 2-1 of the housing 2*c* into the apparatus 1*c* is discharged from the apparatus 1*c* through the opened second outflow openings 6-2 and the second outlet openings 2-5 of the housing 2*c* serving as pre-outlets.

Figure 4C:
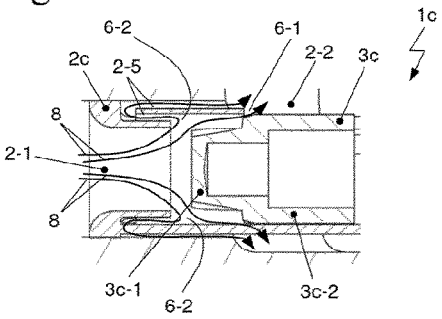

In FIG. 4C, the apparatus 1*c* is shown in a state with opened first outflow openings 6-1 or opened first outlet openings 2-2 of the housing 2*c* as well as opened second outflow openings 6-2 or opened second outlet openings 2-5 of the housing 2*c* and thus a state with a large mass flow in the flow direction 8 of the fluid through the apparatus 1*c* in a detailed representation. Through the movement of the piston element 2*c* in the axial direction caused by a further increasing pressure force created by the flow of the fluid and acting on the piston element 3*c*, the first sealing surfaces 2-3, 3-4 of the first seat are moved further away from each other and the second sealing surfaces 2-4, 3-5 of the second seat are released from each other. The fluid flowing through the inlet opening 2-1 of the housing 2*c* into the apparatus 1*c* is divided into a first partial mass flow flowing out of the apparatus 1*c* through the opened second outflow openings 6-2 and the second outlet openings 2-5 of the housing 2*c* serving as pre-outlets and a second partial mass flow flowing out of the apparatus 1*c* through the opened first outflow openings 6-1. The partial mass flows are mixed in the region of the first outlet openings 2-2 of the housing 2*c* when flowing out of the apparatus 1*c*.

Figure 4D:
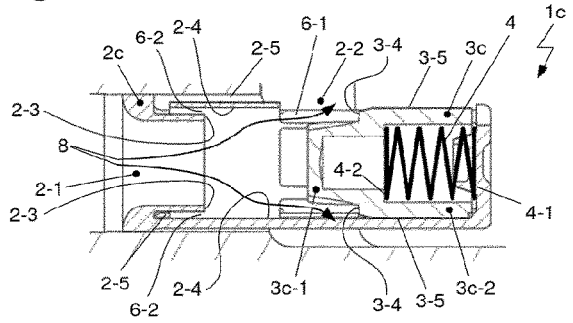

FIG. 4D shows the apparatus 1*c* in a fully opened state with a maximum mass flow in the flow direction 8 of the fluid through the apparatus 1*c*. With the movement of the piston element 3*c* in the axial direction caused by a maximum pressure force created by the flow of the fluid and acting on the piston element 3*c*, both the first sealing surfaces 2-3, 3-4 of the first seat and the second sealing surfaces 2-4, 3-5 of the second seat are further moved away from each other, the seats are fully opened. The fluid flowing through the inlet opening 2-1 of the housing 2*c* into the apparatus 1*c* is substantially guided out of the apparatus 1*c* through the fully opened first outflow openings 6-1.

The third embodiment of the apparatus 1*c* with the second outlet openings 2-5 respectively formed as a pre-outlet or the second outflow openings 6-2 which open first during movement of the piston element 3*c*, while the first outflow openings 6-1 are still closed, are fully controllable in the size of the flow cross section, depending on the mass flow of the fluid flowing through the apparatus 1*c*, in particular in the case of very low mass flows. Also in the case of very low mass flows, the occurring pressure pulsation is reduced due to the flowing through the labyrinth-like pre-outlets 2-5. After a specific stroke of the piston element 3*c*, the first outlet openings 2-2, which are specially configured for the removal of the pressure pulsation, are opened as well as main outlet.

The apparatus 1*c* has an adapted throughflow characteristics for all different mass flows of the fluid. The outflow openings 6-1, 6-2 are adapted to one another such that the damping characteristics are optimal for every load situation.

FIG. 5A to 5E respectively show fourth embodiments and FIG. 6A to 6E respectively show fifth embodiments of an apparatus 1*d*, 1*d*', 1*d*" for damping pressure pulsation for a compressor with a housing 2*c*, 2*c*" as well as a spring-loaded piston element 3a, 3a', 3b, 3b' movably arranged in the axial direction within the volume enclosed by the housing 2c, 2c" in an axial longitudinal cross sectional representation. FIG. 5F shows a piston element 3a of a fourth embodiment and FIG. 6F shows a piston element 3b of a fifth embodiment respectively in a plan view and a perspective representation.

Figure 5A:
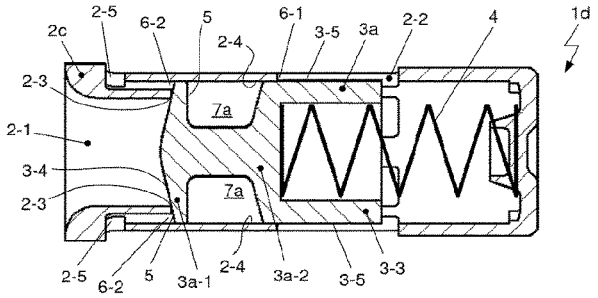
FIG. 5A to 5E: a fourth embodiment with a housing with pre-outlets for the outflow of the fluid and a piston element similar to the first embodiment according to FIG. 1A in a closed state, states respectively for the passage of a minimum mass flow with alternative embodiments of the piston element or of the housing as well as a state for the passage of a medium to large mass flow.
Figure 5B:
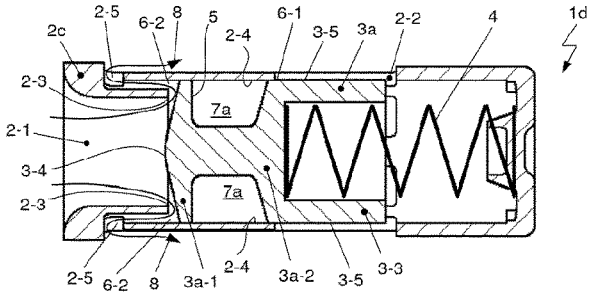
Figure 5C:
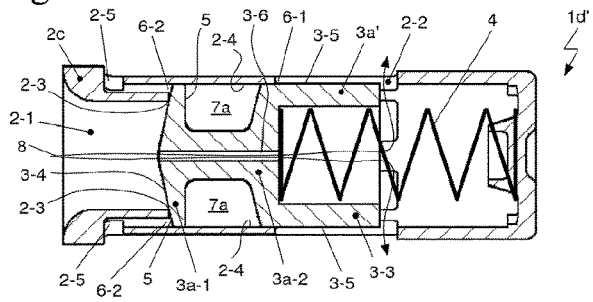
Figure 5D:
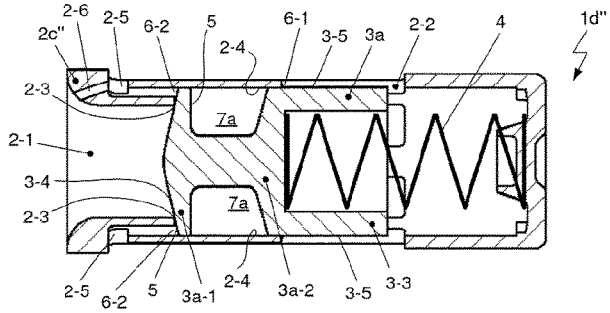
Figure 5E:
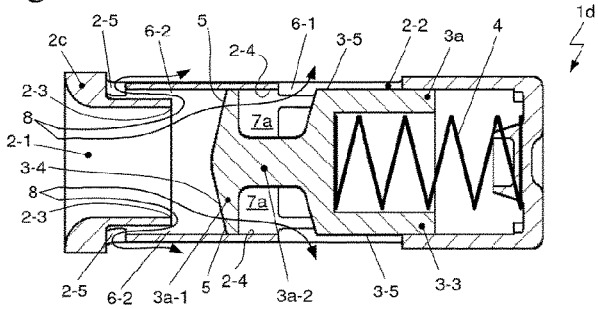
Figure 5F:
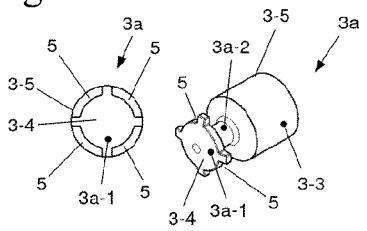
FIG. 5F: the piston element of the fourth embodiment in a plan view and a perspective representation.
Figure 6A:
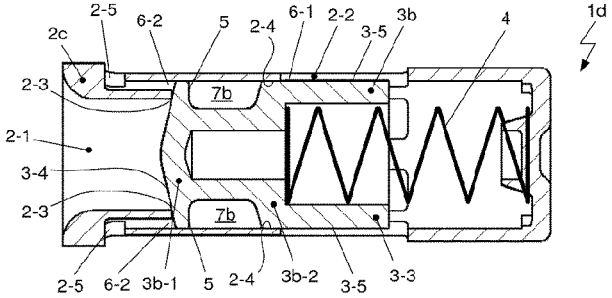
FIG. 6A to 6E: a fifth embodiment with a housing with pre-outlets for the outflow of the fluid and a piston element similar to the second embodiment according to FIG. 1B in a closed state, states respectively for the passage of a minimum mass flow with alternative embodiments of the piston element or of the housing as well as a state for the passage of a medium to large mass flow.
Figure 6B:
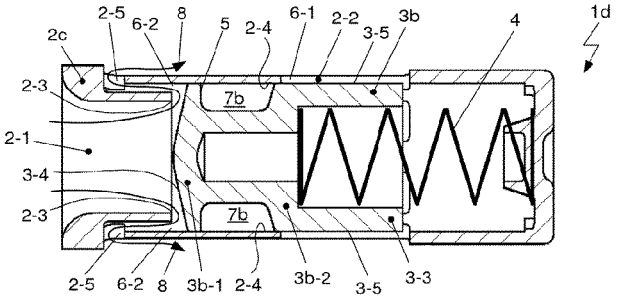
Figure 6C:
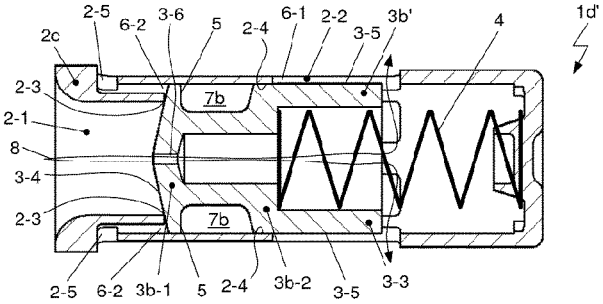
Figure 6D:
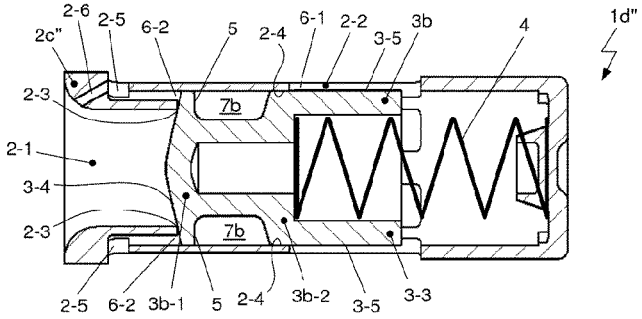
Figure 6E:
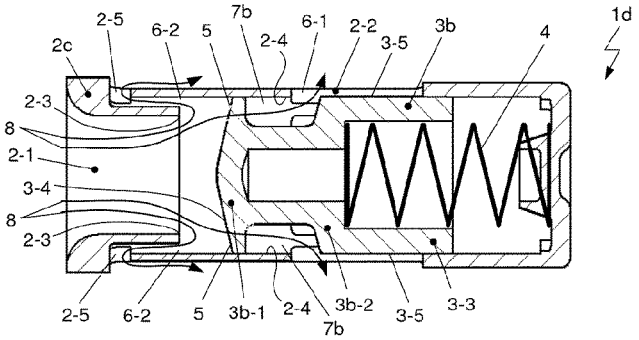
Figure 6F:
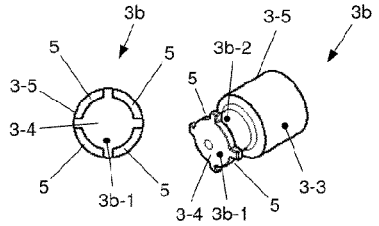
FIG. 6F: the piston element of the fifth embodiment in a plan view and a perspective representation.

The apparatus 1d of a fourth embodiment according to FIGS. 5A, 5B and 5E is formed as a combination of the housing 2c of the third embodiment of the apparatus 1c according to FIGS. 3 and 4A to 4D and the piston element 3a of the first embodiment of the apparatus 1a according to FIG. 1A, while the apparatus 1d of a fifth embodiment according to FIGS. 6A, 6B and 6E represents a combination of the housing 2c of the third embodiment of the apparatus 1c according to FIGS. 3 and 4A to 4D and the piston element 3b similar to the second embodiment of the apparatus 1b according to FIG. 1B. The same elements of the apparatus 1a, 1b, 1c, 1d, 1d', 1d" which are repeated in the different embodiments are characterized with same reference numerals. Reference is made to the description of the individual components of the respective figures.

FIGS. 5A and 6A respectively represent the apparatus 1d in a closed state and therefore without mass flow. The housing 2c and the piston element 3a respectively form two closed seats with respective sealing surfaces 2-3, 3-4, 2-4, 3-5 which abut each other in a sealing manner. Both the first seat with the first sealing surfaces 2-3, 3-4 and the second seat with the second sealing surfaces 2-4, 3-5 are closed. The first sealing surface 3-4 of the piston element 3a, 3b formed at the first section 3a-1, 3b-1 is pressed against the first sealing surface 2-3 which fully encloses the inlet opening 2-1 of the housing 2c through the pressure force applied by the spring element 4. The first section 3a-1, 3b-1 of the piston element 3a, 3b is arranged such that it closes the inlet opening 2-1.

In FIGS. 5B and 6B, the apparatus 1d is respectively arranged in a state for guiding through a lower or minimum mass flow in the flow direction 8 of the fluid exclusively through the second outlet openings 2-5 formed as pre-outlets. In doing so, the first outflow openings 6-1 or the first outlet openings 2-2 of the housing 2c are closed, while the second outflow openings 6-2 or the second outlet openings 2-5 of the housing 2c are opened.

The first sealing surface 2-3 of the housing 2c and the first sealing surface 3-4 of the piston element 3a, 3b of the first seat are arranged spaced apart from each other such that the first seat is opened, while the second sealing surface 2-4 of the housing 2c and the second sealing surface 3-5 of the piston element 3a, 3b of the second seat abut each other such that the second seat is closed. Thus, the fluid only flows through the second outlet openings 2-5 of the housing 2c configured as pre-outlets which are released following a minimum stroke of the piston element 3a, 3b. The fluid flowing through the inlet opening 2-1 of the housing 2c into the apparatus 1d is discharged from the apparatus 1d through the opened second outflow openings 6-2 and the second outlet openings 2-5 of the housing 2c serving as pre-outlets. The chamber 7a, 7b is not flown through by the fluid, but it serves as an expansion volume for the pressure pulses of the fluid which flows in and out through the throughflow openings 5 formed between the first section 3a 1, 3b-1 of the piston element 3a, 3b and the housing 2c.

FIGS. 5C and 6C respectively show an alternative embodiment of the piston element 3a', 3b' and thus of the fourth and fifth embodiment of the apparatus 1d', while FIGS. 5D and 6D respectively show an alternative embodiment of the housing 2c" and thus also of the fourth and fifth embodiment of the apparatus 1d"'. In doing so, the apparatus 1d', 1d" are respectively arranged in a closed state, but for guiding through a minimum mass flow.

The housing 2c, 2c" and the piston element 3a, 3b, 3a', 3b' respectively form two closed seats with respective sealing surfaces 2-3, 3-4, 2-4, 3-5 which abut each other in a sealing manner. Both the first seat with the first sealing surfaces 2-3, 3-4 and the second seat with the second surfaces 2-4, 3-5 are closed.

In the case of the apparatus 1d' according to FIGS. 5C and 6C, the piston element 3a', 3b' respectively has a bypass opening 3-6 for connecting a volume formed at the inlet opening 2-1 with a volume formed at an outlet opening, in particular the first outlet opening 2-2. The bypass opening 3-6 substantially extends in the axial direction through the piston element 3a', 3b', specially through the first section of the piston element 3a', 3b'. When forming the piston element 3b' with a hollow cylindrical second section 3b-2, the bypass opening 3-6 opens into the second volume enclosed by the second section 3b-2 of the piston element 3b', which on the other hand is connected to a volume enclosed by the hollow cylindrical third section 3-3 of the piston element 3b'.

In doing so, the piston element 3a', 3b' has, in the axial direction, such a length that the first outlet opening 2-2 of the housing 2c with a closed second seat and thus abutting second sealing surfaces 2-4, 3-5 of the housing 2c and the piston element 3a', 3b' is not fully closed by the piston element 3a', 3b'. A gap which provides a connection to the outlet opening 2-2 is opened to the housing 2c at an end face of the third section 3-3 of the piston element 3a', 3b' at a distal end oriented to the closed second seat in the axial direction.

The fluid flowing through the inlet opening 2-1 of the housing 2c in the flow direction 8 into the apparatus 1d' is discharged from the apparatus 1d' through the bypass opening 3-6 formed in the piston element 3a', 3b' and the gap formed between the piston element 3a', 3b' and the housing 2c as an opened first outlet opening 2-2.

In the case of the apparatus 1d" according to FIGS. 5D and 6D, the housing 2c" respectively has a bypass opening 2-6 for connecting a volume formed at the inlet opening 2-1 with a volume formed at an outlet opening, in particular the second outlet opening 2-5.

The fluid flowing through the inlet opening 2-1 of the housing 2c" into the apparatus 1d" is discharged from the apparatus 1d" through the bypass opening 2-6 formed in the housing 2c" and the opened second outflow openings 2-5.

In FIGS. 5E and 6E, the apparatus 1d is respectively arranged in a state for guiding through a medium to larger mass flow in the flow direction 8 of the fluid both through the second outlet openings 2-5 formed as pre-outlets and through the chamber 7a, 7b. Apart from the second outflow openings 6-2 or the second outlet openings 2-5 of the housing 2c, the first outflow openings 6-1 or the first outlet openings 2-2 of the housing 2c are opened as well.

Both the first sealing surface 2-3 of the housing 2c and the first sealing surface 3-4 of the piston element 3a, 3b of the first seat and the second sealing surface 2-4 of the housing 2c and the second sealing surface 3-5 of the piston element 3a, 3b of the second are arranged spaced apart from each other, the seats are opened. The fluid flowing through the inlet opening 2-1 of the housing 2c into the apparatus 1d is divided into a first partial mass flow flowing out of the apparatus 1d through the opened second outflow openings 6-2 and the second outlet openings 2-5 of the housing 2c serving as pre-outlets and a second partial mass flow flowing out of the apparatus 1d through the opened first outflow openings 6-1. In doing so, the second partial mass flow of the fluid is guided into the chamber 7*a*, 7*b* through the throughflow openings 5 formed between the first section 3*a*-1, 3*b*-1 of the piston element 3*a*, 3*b* and the housing 2*c* and expanded due to the large increase of the flow cross section. The fluid then flows out of the apparatus 1*d* through the first outflow openings 6-1 as opened second seats under increasing pressure and is again expanded.

The substantial difference of the piston elements 3*a* of the apparatus 1*a*, 1*d* according to FIG. 1A as well as 5A, 5B and 5E is in the form of the first section 3*a*-1. While the outer diameter of the first section 3*a*-1 of the piston element 3*a*, formed as a circular disc, of the first embodiment of the apparatus 1*a* of FIG. 1A is substantially smaller than the inner diameter of the hollow circular cylindrical housing 2*c*, the outer diameter of the first section 3*a*-1 of the piston element 3*a* formed as a circular disc of the fifth embodiment of the apparatus 1*d* of FIGS. 5A, 5B and 5E corresponds to the inner diameter of the hollow circular cylindrical housing 2*c* minus only a gap for moving the piston element 3*a* within the housing 2*c*.

FIGS. 5F and 6F in particular show the formation of the recesses at the circumferential surface of the first section 3*a*-1, 3*b*-1 of the piston element 3*a*, 3*b* formed as a circular disc. The recesses which respectively provide open flow paths for the fluid respectively have the shape of a circular ring section. In doing so, adjacently arranged circular ring sections are separated from each other by webs. The webs extend in the radial direction to the outside to the maximum outer diameter of the first section 3*a*-1, 3*b*-1 of the piston element 3*a*, 3*b*. The four webs which are uniformly distributed about the circumference of the circumferential surface thus divide a circular ring formed between the wall at the inner diameter of the hollow circular cylindrical housing 2*c* and the circumferential surface of the first section 3*a*-1, 3*b*-1 of the piston element 3*a*, 3*b* into four equal circular ring sections with equal flow cross sections.

Figure 7A:
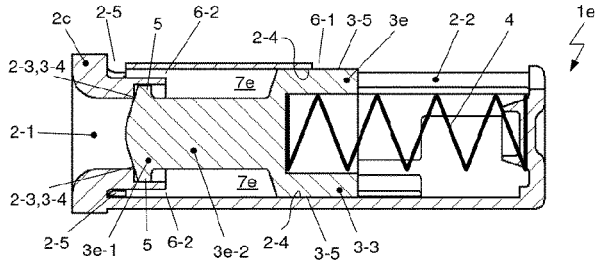
FIG. 7A to 7C: a sixth embodiment with a housing with pre-outlets for the outflow of the fluid and a deviating design of the piston element in a closed state in comparison to the above apparatus, a state for the passage of a low or minimum mass flow through an expansion chamber and exclusively through the pre-outlets and a state for the passage of a large mass flow.
Figure 7B:
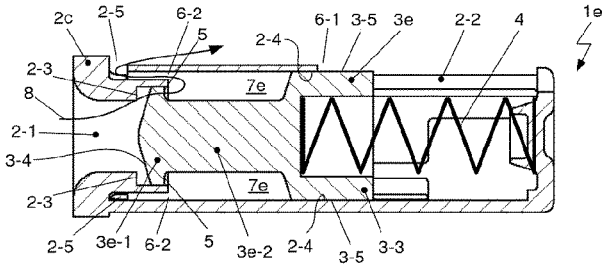
Figure 7C:
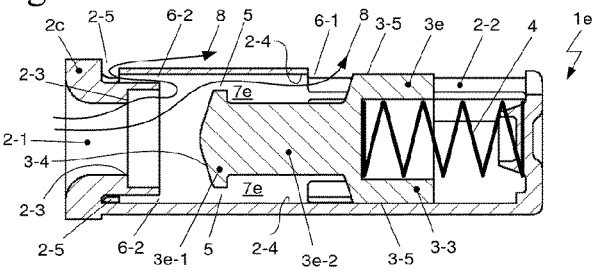

FIG. 7A to 7C respectively reveal a sixth embodiment of an apparatus 1*e* for damping pressure pulsation for a compressor with a housing 2*c* with pre-outlets for the outflow of the fluid as well as a spring-loaded piston element 3*e* formed in a deviating manner from the above apparatus 1*a*, 1*b*, 1*c*, 1*d*, 1*d*', 1*d*" movably arranged in the axial direction within the volume enclosed by the housing 2*c* in an axial longitudinal cross sectional representation.

The apparatus 1*e* of the sixth embodiment according to FIG. 7A to 7C is formed as a combination of the housing 2*c* of the third embodiment of the apparatus 1*c* according to FIGS. 3 and 4A to 4D and a combination of the piston element 3*a* of the first embodiment of the apparatus 1*a* according to FIG. 1A and the piston element 3*b* of the second embodiment of the apparatus 1*b* according to FIG. 1B. The same elements of the apparatus 1*a*, 1*b*, 1*c*, 1*d*, 1*d*', 1*d*", 1*e* which are repeated in the different embodiments are characterized with same reference numerals. Reference is made to the description of the individual components of the respective figures.

The substantial difference of the apparatus 1*e* according to FIG. 7A to 7C to the apparatus 1*d* according to FIGS. 5A, 5B and 5E as well as 6A, 6B and 6E is in the form of the housing 2*c* and the piston element 3*a*, 3*b*, 3*e*, in particular in their correspondence behavior during states for guiding through a smaller or minimum mass flow.

The outer diameter of the first section 3*e*-1 of the piston element 3*e* of the sixth embodiment of the apparatus 1*e* formed as a circular disc is substantially smaller than the inner diameter of the hollow circular cylindrical housing 2*c* and therefore corresponds to the form of the first section 3*a*-1 of the piston element 3*a* of the first embodiment of the apparatus 1*a* according to FIG. 1A. The outer diameter of the second section 3*e*-2 of the piston element 3*e* of the sixth embodiment of the apparatus 1*e* formed as a cylinder, in particular as a circular cylinder, substantially corresponds to the outer diameter of the second section 3*b*-2 of the piston element 3*b* of the second and the fifth embodiment of the apparatus 1*b*, 1*d* according to FIG. 1B or 6A, 6B and 6E.

FIG. 7A shows the apparatus 1*e* in a closed state, while the apparatus 1*e* in FIG. 7B is shown in a state for guiding a smaller or minimal mass flow in the flow direction 8 of the fluid through a chamber 7*e* and then through the second outlet openings 2-5 formed as pre-outlets. The first outflow openings 6-1 or the first outlet openings 2-2 of the housing 2*c* are respectively closed, while the second outflow openings 6-2 or the second outlet openings 2-5 of the housing 2*c* are closed in the closed state of the apparatus 1*e* of FIG. 7A and opened in the state of FIG. 7B and connected to the chamber 7*e*.

In the state for guiding through a lower or minimum mass flow of FIG. 7B, the first sealing surface 2-3 of the housing 2*c* and the first sealing surface 3-4 of the piston element 3*b* of the first seat are either spaced apart from each other forming a minimum gap or are at least arranged with regard to one another such that the throughflow openings 5 formed by the first section 3*e*-1 of the piston element 3*e* together with the housing 2*c* are at least partially opened such that the first seat is opened as well. Furthermore, the second sealing surface 2-4 of the housing 2*c* and the second sealing surface 3-5 of the piston element 3*e* of the second seat abut one another such that the second seat is closed. Thus, the fluid can only flow through the second outlet openings 2-5 of the housing 2*c* configured as pre-outlets and connected to the chamber 7*e*. The fluid flowing through the inlet opening 2-1 of the housing 2*c* into the apparatus 1*e* is guided into the chamber 7*e* through the throughflow openings 5 formed between the first section 3*e*-1 of the piston element 3*e* and the housing 2*c* and expanded due to the large increase of the flow cross section. The fluid then flows out of the apparatus 1*e* through the opened second outflow openings 6-2 and the second outlet openings 2-5 of the housing 2*c* serving as pre-outlets.

Through the movement of the piston element 2*c* in the axial direction caused by the pressure force created by the flow of the fluid and acting on the piston element 3*e* first sealing surfaces 2-3, 3-4 of the first seat can be moved further away from each other and the second sealing surfaces 2-4, 3-5 of the second seat can be released from each other. The fluid flowing through the inlet opening 2-1 of the housing 2*c* into the apparatus 1*e* is then divided into a first partial mass flow flowing out of the apparatus 1*e* through the opened second outflow openings 6-2 and the second outlet openings 2-5 of the housing 2*c* serving as pre-outlets and a second partial mass flow flowing out of the apparatus 1*e* through the opened first outflow openings 6-1.

FIG. 7C shows the apparatus 1*e* in a state for guiding through a medium to large mass flow in the flow direction 8 of the fluid both through the second outlet openings 2-5 formed as pre-outlets and through the chamber 7*e*, similar to the state of the fourth or fifth embodiment of the apparatus 1*d* of FIGS. 5E and 6E. Apart from the second outflow openings 6-2 or the second outlet openings 2-5 of the housing 2*c*, the first outflow openings 6-1 or the first outlet openings 2-2 of the housing 2*c* are opened as well. Reference is made to the representation of FIGS. 5E and 6E for further explanations.

As the outflow openings 6-1, 6-2 are arranged distributed around the circumference of the apparatus 1*e*, the mass flow for a respective outflow opening 6-1, 6-2 respectively represented with the flow direction 8 is represented as an example.

Figure 7D:
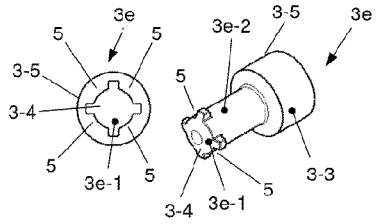
FIG. 7D: the piston element of the sixth embodiment in a plan view and a perspective representation.

FIG. 7D reveals the piston element 3*e* of the sixth embodiment of the apparatus 1*e* in a plan view and a perspective representation. The recesses provided at the circumferential surface of the first section 3*e*-1 of the piston element 3*e* and providing open flow paths for the fluid, on the other hand, respectively have the form of a circular ring section. The circular cylindrical first section 3*e*-1 and the circular cylindrical second section 3*e*-2 of the piston element 3*e* are formed with outer diameters of equal size.

The webs separating the adjacently arranged circular ring sections from each other respectively extend from the outer diameter of the circular cylindrical first section 3*e*-1 in the radial direction to the outside.

The through openings formed as bypass openings 2-6 in the housing 2*c*" or as bypass openings 3-6 in the piston element 3*a*', 3*b*' are to be regarded as alternative designs of the housing 2*a*, 2*c*, 2*c*" and of the piston element 3*a*, 3*a*', 3*b*, 3*b*', 3*c*, 3*e* irrespective of the embodiment of the apparatus 1*a*, 1*b*, 1*c*, 1*d*, 1*d*', 1*d*", 1*e*. A combination of the different housings 2*a*, 2*c*, 2*c*" and piston elements 3*a*, 3*a*', 3*b*, 3*b*', 3*c*, 3*e* in an apparatus is possible as well.

Similarly, the second outlet openings 2-5 formed as pre-outlets can either be configured, as represented in the housing 2*c*, 2*c*" of the apparatus 1*c*, 1*d*, 1*d*', 1*d*", 1*e* or in a wall of a component enclosing the housing 2*c*, 2*c*", for example of the refrigerant circuit, in particular of the compressor or of a connection line, independent of the embodiment of the apparatus 1*c*, 1*d*, 1*d*', 1*d*", 1*e*.

With the apparatus 1*c*, 1*d*, 1*d*', 1*d*", 1*e* of FIGS. 3 to 7D, respectively with the housing 2*c*, 2*c*" with pre-outlets, an optimum damping effect is achieved on the one hand and at the same time an excessive pressure loss is avoided.

LIST OF REFERENCE NUMERALS

1*a*, 1*b*, 1*c*, 1*d*, 1*d*', 1*d*", 1*e* apparatus
2*a*, 2*c*, 2*c*" housing
2-1 inlet opening
2-2 (first) outlet opening
2-3 first sealing surface of the housing 2*a*, 2*c*, 2*c*"
2-4 second sealing surface of the housing 2*a*, 2*c*, 2*c*"
2-5 second outlet opening, pre-outlet
2-6 bypass opening of the housing 2*c*"
3*a*, 3*a*.', 3*b*, 3*b*', 3*c*, 3*e* piston element
3*a*-1, 3*b*-1, 3*c*-1, 3*e*-1 first section of the piston element 3*a*, 3*a*.', 3*b*, 3*b*' 3*c*, 3*e*
3*a*-2, 3*b*-2, 3*c*-2, 3*e*-2 second section of the piston element 3*a*, 3*a*.', 3*b*, 3*b*', 3*c*, 3*e*
3-3 third section of the piston element 3*a*, 3*a*.', 3*b*, 3*b*', 3*e*
3-4 first sealing surface of the piston element 3*a*, 3*a*.', 3*b*, 3*b*', 3*c*, 3*e*
3-5 second sealing surface of the piston element 3*a*, 3*a*.', 3*b*, 3*b*', 3*c*, 3*e*
3-6 bypass opening of the piston element 3*a*.', 3*b*'
4 spring element
4-1 support of the housing 2*a*, 2*c*, 2*c*"
4-2 support of the piston element 3*a*, 3*a*.', 3*b*, 3*b*', 3*c*, 3*e*
5 throughflow opening
6, 6-1 (first) outflow opening
6-2 second outflow opening
7*a*, 7*b*, 7*e* chamber
8 flow direction of the fluid

The invention claimed is:

1. An apparatus for damping pressure pulsation for a compressor of a gaseous fluid, the apparatus comprising:

a housing with an inlet opening and at least one first outlet opening, and a piston element which is movable in an axial direction within a volume enclosed by the housing and is arranged in a beared manner supported on the housing via a spring element, wherein a movement of the piston element respectively controls a flow cross section of the inlet opening and of the at least one first outlet opening, wherein the piston element and the housing each respectively have at least one first sealing surface and at least one second sealing surface, wherein the at least one first sealing surface forms a first seat and the at least one second sealing surface forms a second seat, wherein between the first seat and the second seat respectively at least one chamber is formed and enclosed by the housing and the piston element for expanding the gaseous fluid when flowing into the at least one chamber, and wherein at least one second outlet opening in the housing is formed, wherein the at least one second outlet opening is arranged adjacent to the at least one first sealing surface of the housing such that the at least one first sealing surface of the housing is arranged in a radial direction between the inlet opening and the at least one second outlet opening, wherein the at least one second outlet opening is formed as a flow channel with a flow cross section smaller than a flow cross section of the at least one first outlet opening, wherein the at least one second outlet opening includes at least one change in flow direction, and wherein two straight sections of the at least one second outlet opening are respectively oriented in parallel relationship to the inlet opening and connected to one another via a deflection section such that a mass flow of the gaseous fluid which is guided through the at least one second outlet opening, experiences a first deflection of 180° after flowing through the inlet opening and and experiences a second 180° deflection after flowing through the deflection section.

2. The apparatus according to claim 1, wherein the housing has a hollow cylindrical shape with an open first end face and a closed second end face distally arranged to the open first end face, wherein the open first end face of the housing is formed as the inlet opening for the gaseous fluid, wherein the at least one first outlet opening is formed on an outer surface and in a region of the closed second end face of the housing, wherein the at least one first sealing surface of the housing is formed such that it fully encloses the inlet opening, and wherein the at least one second sealing surface of the housing is formed at an inner wall and fully enclosing the inner wall and in a region of a side of the at least one first outlet opening oriented towards the inlet opening.

3. The apparatus according to claim 1, wherein the piston element is formed from at least two sections which are arranged such that they are oriented towards one another on a common longitudinal axis in the axial direction.

4. The apparatus according to claim 3, wherein the at least two sections comprise a first section, a second section, and a third section, wherein the first section of the piston element is formed in a shape of a circular disc, and wherein the first section of the piston element is formed with a convexly curved end surface which is arranged oriented towards a direction of the inlet opening of the housing.

5. The apparatus according to claim 1, wherein the piston element has a first section and a second section, wherein the first section of the piston element is formed in a shape of a circular truncated cone or a hollow cylinder with a conical outer surface and a closed first end face.

6. The apparatus according to claim 5, wherein an outer diameter of the first section of the piston element is smaller than an inner diameter of the housing, such that an annular flow path for the gaseous fluid is formed between an inner wall of the housing and a circumferential surface of the first section of the piston element.

7. The apparatus according to claim 1, wherein the at least one first sealing surface of the piston element is formed at a surface of a first section of the piston element oriented towards a direction of the inlet opening of the housing or at a first end face of a second section of the piston element oriented towards the direction of the inlet opening of the housing.

8. The apparatus according to claim 7, wherein the at least one first sealing surface is formed such that it fully encloses the first section of the piston element.

9. The apparatus according to claim 1, wherein the at least one second sealing surface of the piston element is formed at an outer wall of a third section of the piston element or at an outer wall of a second section of the piston element.

10. The apparatus according to claim 1, wherein the piston element has a bypass opening which is formed extending from an end face oriented in a direction of the inlet opening of the housing in the axial direction through the piston element.

11. The apparatus according to claim 1, wherein the housing has a bypass opening which connects a volume formed at the inlet opening to a volume formed at the at least one second outlet opening.

12. The apparatus according to claim 1, wherein the spring element is arranged concentrically within the piston element at least in regions depending on a deflection.

13. The apparatus according to claim 1, wherein the piston element is arranged in an end position in a minimal distance to the inlet opening of the housing such that the flow cross section of the inlet opening and/or of the at least one first outlet opening of the housing is/are closed.

14. The apparatus according to claim 1, wherein the piston element is arranged in an end position in a maximal distance to the inlet opening of the housing such that the flow cross section of the inlet opening and of the at least one first outlet opening are fully opened.

* * * * *